United States Patent [19]

Hugin

[11] 4,224,973

[45] Sep. 30, 1980

[54] DRIVE MECHANISM, PARTICULARLY FOR MOVING AND TURNING THE SLATS OF A BLIND

[76] Inventor: Walter Hugin, Am Scherbenrain 13, D-7841 Kleinkems, Fed. Rep. of Germany

[21] Appl. No.: 857,746

[22] Filed: Dec. 5, 1977 (Under 37 CFR 1.47)

[51] Int. Cl.[2] ..... E06B 9/38

[52] U.S. Cl. ..... 160/178 R

[58] Field of Search ..... 160/166–178; 192/DIG. 2, 12 R, 483

[56] References Cited

U.S. PATENT DOCUMENTS 3,455,364 7/1969 Fukuoka ..... 160/176

3,789,905 2/1974 Saito ..... 160/176

*Primary Examiner*—Peter M. Caun

*Attorney, Agent, or Firm*—Irvin A. Lavine

[57] ABSTRACT

A drive mechanism, particularly for moving and turning the slats of a blind, is disclosed. The drive mechanism comprises a suitable drive element for driving one or the other of a first and a second shaft. Connected between the drive element and the first shaft there is connected a freewheel which is contained between two end positions and is in effect during the rotation of the second shaft in both directions. A clutch is connected between the drive element and the second shaft to automatically decouple the second shaft from the drive element on completion of the freewheel action.

20 Claims, 11 Drawing Figures

DRIVE MECHANISM, PARTICULARLY FOR MOVING AND TURNING THE SLATS OF A BLIND

This invention relates to a drive mechanism, particularly for moving and turning the slats of a blind, comprising a rotatable drive element rotation of which can be transferred alternately to one or other of a first and a second shaft.

Basically, a drive mechanism of the above mentioned kind can always be used when two shafts with mutually related functions are to be driven alternately by means of one drive mechanism. The drive mechanism according to the invention is particularly suitable for the drive of blinds, especially those with slats arranged vertically. The slats here can be moved transversly with respect to their longitudinal extension as well as pivoted about their own axis, by means of the same drive mechanism. In a way known perse vertically arranged slats are supported at least at their upper end in slat-guide means which themselves can be shifted along a horizontal guide rail and through which passes a screw drive and a reversing shaft. When the reversing shaft is turned the slats are turned about their axis by worm gears built into the guide carriages, while any rotation of the screw drive is converted by appropriate gear mechanisms into a shifting motion of the individual guide carriages in the guide rail.

Drive mechanisms are known in which for the screw drive and the reversing shaft two separate drive wheels are provided, each with a bead chain which engages the drive wheel or each with a cord pull. Different drive elements must, therefore, be operated in alternating directions in order the shift and turn the slats, which is inconvenient, and leads to confusion. wrong operation of the drive elements can also cause the drive mechanism to be damaged.

A drive mechanism has also been proposed with a single drive wheel, the rotation of which is transferred to a single drive spindle and with a change in the direction of rotation is converted firstly into a turning movment and then into a shifting movement of the slats. With completion of the turning movement of the slats slipping clutches come into operation which prevent further pivoting of the slats. Although only one drive element is to be operated by means of a bead chain or cord pull with this drive mechanism, a certain sluggishness results from overcoming the frictional forces in the slipping clutches, as well as increased wear. Besides, because of the sluggishness the size of the blind cannot be freely increased.

Finally, a switch-over gear unit is known for the alternate coupling of screw drive or reversing shaft to one common drive wheel. Here the disadvantages of the constructions described above have been avoided, but each time a change is required in the direction of rotation of the drive element, e.g. to switch over from moving to turning of the slats. The user sometimes feels that this is complicated. Also with slats guided at both ends by means of guide rails it is not readily possible to apply this switch-over gear unit to both guide rails since synchronous switch-over of both switch-over gear units can not be guaranteed.

It is an object of the present invention to provide a drive mechanism in which, as in the prior arrangement described above, the rotation of a single drive wheel is transferred firstly to one shaft, e.g., the reversing shaft, and after a limited delay, e.g., on completion of the pivoting movement of the slats, automatically to the other shaft, e.g., the screw drive. The drive mechanism must also work relatively freely and be subject to little wear.

According to the invention there is provided a drive mechanism, particularly for moving and turning the slats of a blind, comprising a rotatable drive element rotation of which can be transferred alternately to one or other of a first and a second shaft, between the drive element and the first shaft there is connected a freewheel which is constrained between two end positions and is in effect during the rotation of the second shaft in both directions and wherein a clutch is connected between the drive element and the second shaft automatically to decouple the second shaft from the drive element on completion of the freewheel action.

In an embodiment of the invention in which the first shaft is constructed as a screw drive for shifting the slats of a blind along a guide rail, and second shaft acts as a reversing shaft for turning the slats jointly, and the drive element is constructed as a drive wheel, it is arranged that a drive wheel is connected as a rotary drive to a drive tube containing a control shaft which can be pivoted to two end positions relative to the drive tube against the force of a return spring, where the profile of the control shaft is provided with recesses each of which is assigned to an opening in the drive tube, in each one of which a blocking element is arranged to be moveable radically between an inner position which fits against a recess of the control shaft and an outer positon which fits against a section of the control shaft profile which is not formed by a recess, and that in the region of the blocking elements the drive tube is enclosed by a first toothed casing coupled to the reversing shaft and from the inner surface of which dogs protrude inward into the path of the movement of the blocking elements located in the outer position.

In the drive mechanism according to the invention, therefore, independently of the direction of the rotation of the drive wheel the rotation at first is transferred only to the reversing shaft which is decoupled automatically after the slats have reached an end position, at which time the screw drive is coupled in automatically since the freewheel action has finished. Thus the slats are firstly pivoted in the same direction and then moved apart or together when the drive mechanism is operated, i.e., when the drive wheel is turned in one direction. If the direction of rotation of the drive wheel or the direction of pulling at the operating chain is altered independently of the position of adjustment reached the slats are first turned about their longitudinal axis to the opposite turn-stop and then are moved together or apart. For the user this has the advantage that he has to pull always only in one direction to pivot the slats successively and move them apart or together without additional handling. Should the user require the slats to be turned differently after they have been moved apart or together he only has to change the direction of rotation of the drive wheel for a short time. The frictional load is relatively small since only a single clutch and a single freewheel are required for the whole drive mechanism. The drive power to be expended, therefore, is much less than with known arrangements.

In one embodiment of the invention the drive wheel is connected as a rotary drive to a drive tube containing a control shaft which can be turned from a central rest position relative to the drive tube to two end positions against the force of a return spring, the control shaft profile being provided with recesses, each of which is assigned to an opening in the drive tube, in each one of which a blocking element is arranged to be movable radially between an inner position which fits against a recess of the control shaft and an outer position which fits against a section of the control shaft profile which is not formed by a recess, and in the region of the blocking elements the drive tube is enclosed by a first toothed casing coupled to the reversing shaft and from the inner surface of which dogs protrude inward into the path of the movement of the blocking elements located in the outer position.

Such a blocking element clutch is particularly well suited to engage and disengage the reversing shaft since on completion of the freewheel action between drive and screw drive suddenly an increased torque must be produced to drive the screw drive and thus to shift the guide carriages of all the slats. This sharply increased torque can be utilized to engage the reversing shaft and to disengage it by turning the control shaft against the drive tube into the disengaged position against the force of a return spring and by maintaining this disengaged or twisted position automatically for as long as the slats are being moved by means of the screw drive. When the load is taken off the drive wheel the drive tube is also relieved and the return spring automatically resets the control shaft into the engaged position. Subsequent rotation of the drive wheel, therefore, again results in turning the slats in the opposite direction. With the completion of the turning movement the freewheel action at the screw drive also ends and the torque load increases again, ensuring that the reversing shaft is disengaged in this direction of rotation. The return spring here is loaded in the opposite direction.

The blocking elements of the clutch preferably consist of rollers the longitudinal axes of which are arranged parallel to the axis of the drive tube.

The control shaft and the drive tube may be connected with the screw drive via the freewheel through the provision on the control shaft of a radially protruding follower spring which is coupled to the screw drive via the freewheel and passes outward through an opening which limits the two end positions of the control shaft with relation to the drive tube. Thus the follower spring positively engages the drive tube only on completion of the disengagement of the reversing shaft clutch. For the duration of the freewheel action the follower dog receives the relatively small rotational force required for this via the return spring and the control shaft. Once the freewheel action has finished the torque rises so much that the return spring is loaded and the control shaft is turned against the drive tube, thus causing the reversing shaft to disengage, on the one hand, and on the other hand the follower spring to be turned to one end of its associated opening in the drive tube. Thus the drive power of the drive tube is now transmitted directly to the follower spring and this now drives the screw drive for the guide carriages via the freewheel stopped at one end of its travel. When the load is taken off the drive wheel the control shaft is reset again relative to the drive tube in the manner described and the reversing shaft is thus engaged.

The drive tube may be connected to the control shaft by means of the return spring by arranging a radial disc firmly rotationally joined to the control shaft in an expanded part of the drive tube, and which has a projection pointing in the axial direction which fits against a projection pointing radially inward from the inner surface of the expanded part of the drive tube, and in that the two ends bent outward of the return spring encircling the control shaft fit laterally in the direction of rotation against the two projections. This guarantees in a particularly simple way the action described above during the engaging and disengaging of the reversing shaft.

The return spring is here suitably constructed as a helical spring and arranged in a radial slot between each face of the expanded part of the drive tube and the radial disc.

The freewheel can be arranged basically between the drive tube and the screw drive at a driven gear wheel connected with the drive tube. For instance, it is also possible to pass the control shaft axially out of the drive tube and to provide the freewheel between the control shaft and a casing enclosing the latter with a friction cone which is pressed by spring tension against the corresponding friction cone of a fixed housing component of the mechanism. The place of installation of the freewheel within the drive can thus be changed according to the application.

In one preferred embodiment the follower spring engages an axial groove in the inner surface of a second toothedcasing enclosing the drive tube and where the second toothed casing meshes with a third one connected to the screw drive via the limited freewheel.

The limited freewheel may be formed by the provision of an axial groove on the inner surface of a toothed casing which is coupled to the drive element via the clutch, e.g., the above mentioned third toothed casing, and which encloses a freewheel shaft rigidly connected with the screw drive and provided on its outer surface with a groove which helically encircles the longitudinal axis of the freewheel shaft, a rolling body being provided at the place where the helical groove crosses the groove of the third toothed casing. The arrangement of the rolling body in the helical groove as well as the length of the latter are adjusted to the rotational position of the slats in such a way that in each case the arrival of the cylindrical body at one end of the helical groove coincides with one rotational end position of the slats.

The rolling body is suitably shaped as a sphere or cylinder and the cross-sections of the two grooves taking the rolling body are fitted to its cross-section. This results in a very simple freewheel with low frictional loss and an action the duration of which is limited to the duration of the rotational movement of the slats about their own longitudinal axis.

The rotational torque occurring at the end of the freewheel action can be increased further by a brake mechanism in order to guarantee that the reversing shaft always disengages against the return spring tension at the right point of time. This is achieved by providing the freewheel shaft with a brake cone against which a brake disc is fixed in the direction of rotation is pressed by means of a compression spring. The brake disc here is supported to be rotatable on the freewheel shaft itself and with a radial protrusion projects into an axial groove of a fixed housing enclosing the whole drive mechanism.

The rotational torque occurring can be increased by this braking effect by a suitable amount so that at the end of the freewheel action the reversing shaft always safely disengages.

The braking action can be made adjustable through a simple measure by constructing the compression spring to be a helical spring encircling one end section of the freewheel shaft and the pressure of which against the brake disc can be adjusted by means of a stop plate and a screw inserted into the end of the freewheel shaft. Thus the amount the rotational torque increases at the end of the freewheel action can be adjusted at will by simply turning a single screw.

During the drive of the two shafts, for instance the screw drive and reversing shaft of a blind-drive, relatively large rotational torques may be required which, in turn, put a large load on the parts of the drive, particularly the limited freewheel in its end positions. The forces and contact pressures this gives rise to can result in wear and, with inaccurate production, also in jamming. Besides, with the freewheel described above no further possibility exists to change the number of idle rotations between the gearwheel casing and its driven shaft, e.g., the screw drive, since important dimensions such as, e.g., the spindle length or others, must be altered.

With the smallest possible size of construction this freewheel, therefore, should be suited to the transfer of large rotational torques by means of large stop areas. It should also be possible to change the number of idle revolutions without charging the external dimensions and the individual components of the freewheel should be of simple construction and suitable for plastic mass production In one embodiment of the invention a toothed casing coupled to the drive element via the clutch encloses a tubular basic body and is supported to be rotatable on this latter but fixed in the axial direction, the basic body being connected fixed in rotation to the first shaft and containing a blocking shaft which can be turned with respect to the basic body, that the blocking shaft is provided with a recess which extends over a part of its circumference and that it is connected fixed in rotation with an annular disc carrying a radial inner toothed rim, the inner toothed rim meshing with the toothing of a toothed ring arranged to rotate in an eccentric cylindrical recess of the toothed casing and fixed in rotation relative to the basic body and the number of teeth of the inner toothed rim and of the toothing of the toothed ring being different, that a blocking element is arranged in an opening of the basic body in the region of the toothed casing to be movable radially between an inner position fitting against the blocking shaft recess and an outer position fitting against the unrecessed circumference of the blocking shaft, and that from the inner surface of the toothed casing a constriction extending over part of its circumference projects inward into the path of movement of the blocking element located in its outer position.

In order to make the stop areas in the end positions of the limited freewheel as large as possible and thus to make the contact pressure as small as possible, the opening in the basic body is preferably shaped elongated in the axial direction and contains a cylindrical blocking element, the recess of the blocking shaft and the constriction of the toothed casing extending at least over the axial length of the blocking element.

The components of the freewheel are held together quite simply since the blocking shaft is made hollow and a pin passes through it axially which is fixed axially at the end of the blocking shaft, on the one hand, and at an inner step of the basic body on the other hand.

The toothed ring of the freewheel may be rotationally fixed to the basic body by engaging an axial projection of the basic body in a corresponding recess of the toothed ring.

The toothed casing is advantageously fixed axially by fixing it in an axial direction, but rotatable, between an annular projection of the basic body and the annular disc.

The invention will now be described, by way of example, with reference to the accompanying drawings, in which.

Figures 1, 2, 3:
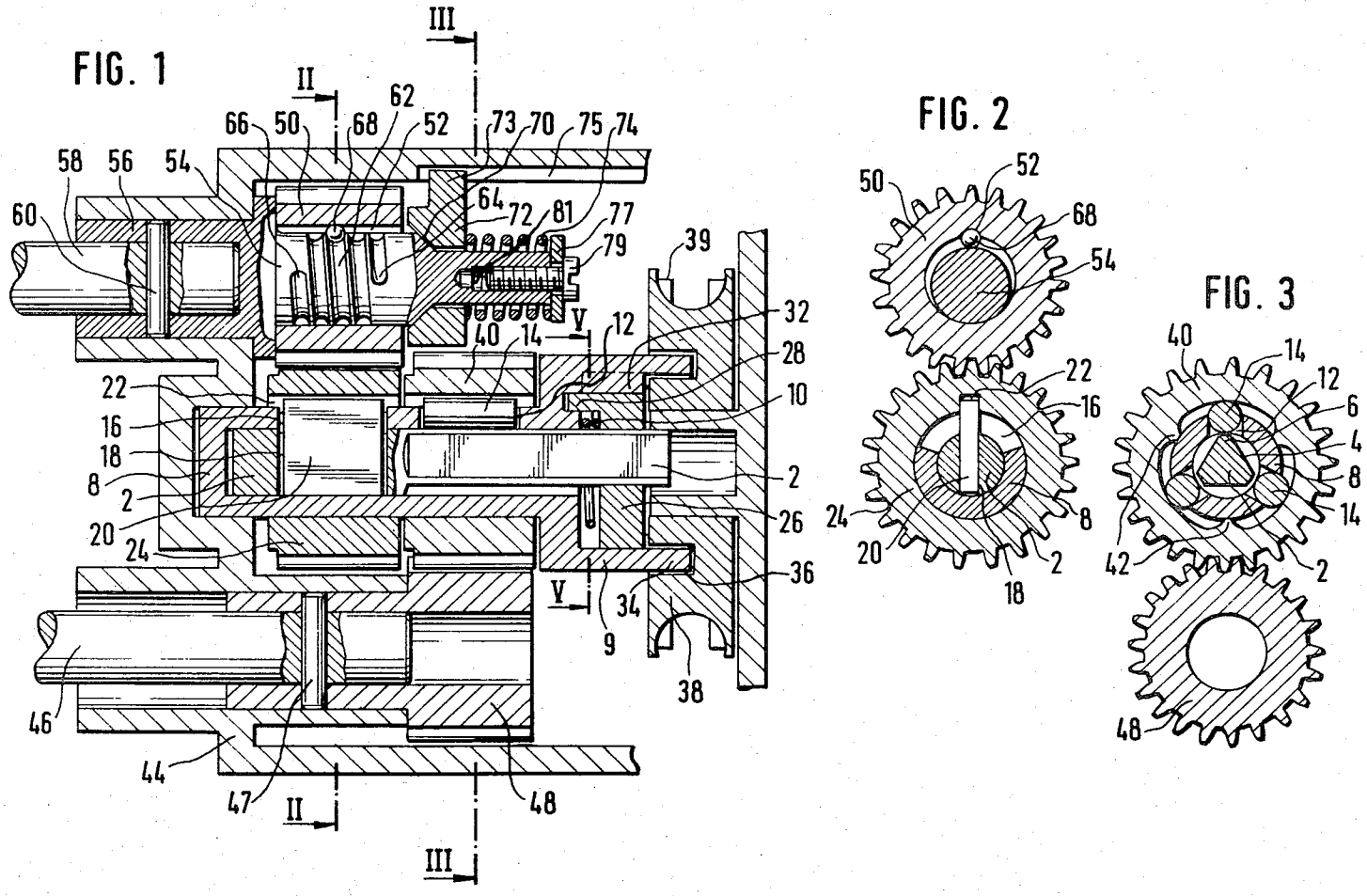
FIG. 1 is an axial section through a drive mechanism according to the invention for the slats of blinds with a part of the housing enclosing it.
FIG. 2 is a radial section along line II—II in FIG. 1.
FIG. 3 is a radial section along line III—III in FIG. 1 with engaged reversing shaft.
Figure 4:
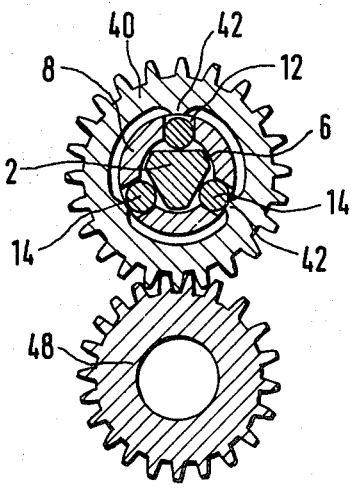
FIG. 4 is a radial section corresponding to FIG. 3 with disengaged reversing shaft.
Figure 5:
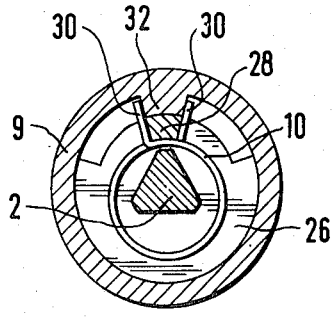
FIG. 5 is a radial section along line V—V in FIG. 1.
Figure 6:
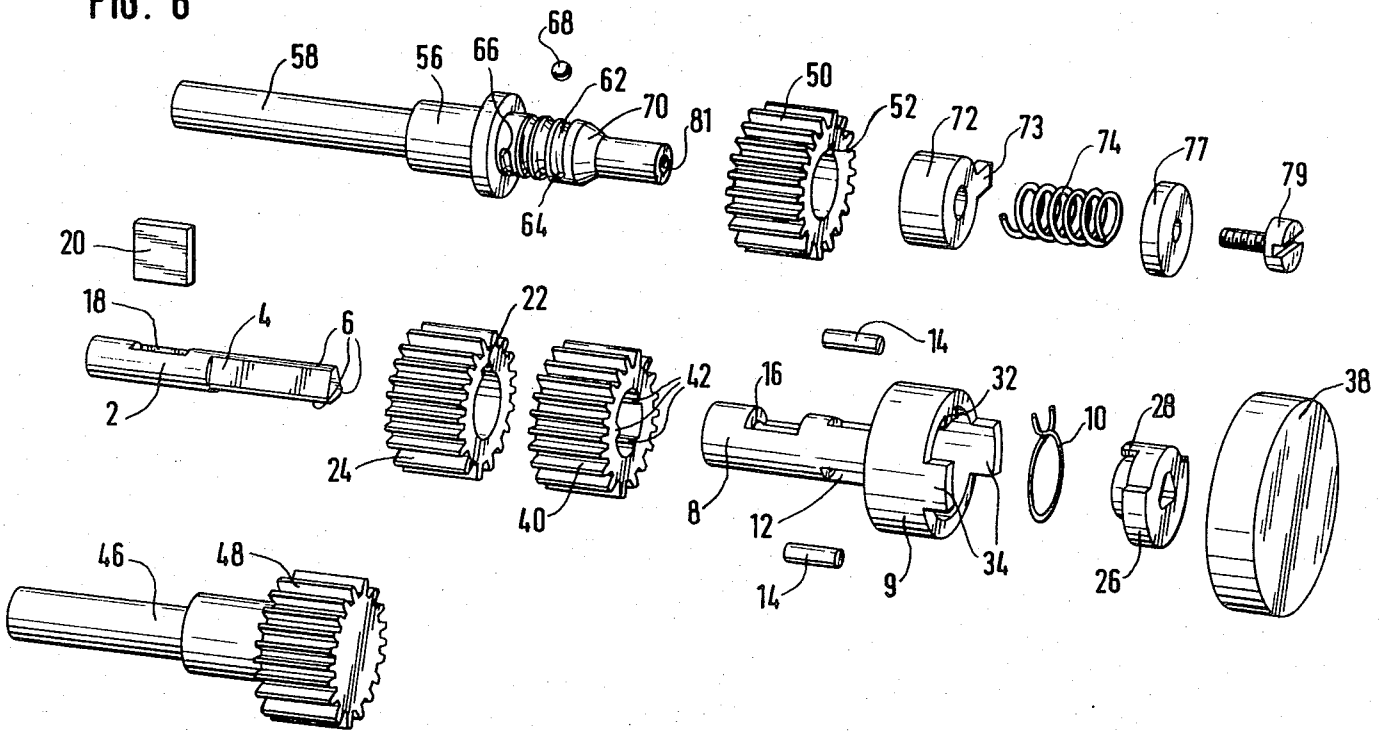
FIG. 6 is an exploded view of the individual components of the drive mechanism according to FIGS. 1 to 5.
Figure 7:
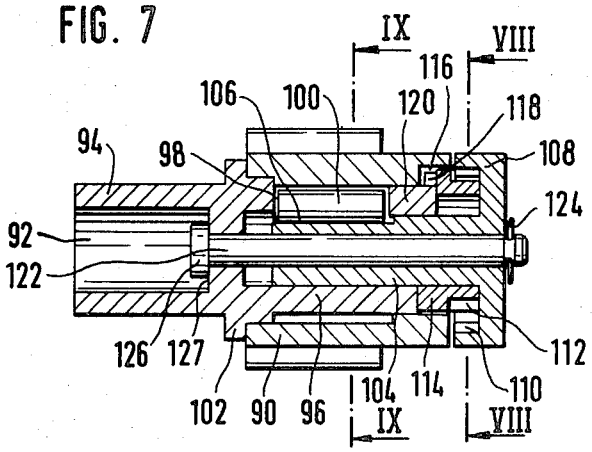
FIG. 7 is an axial section through a second embodiment of a freewheel.
Figure 11:
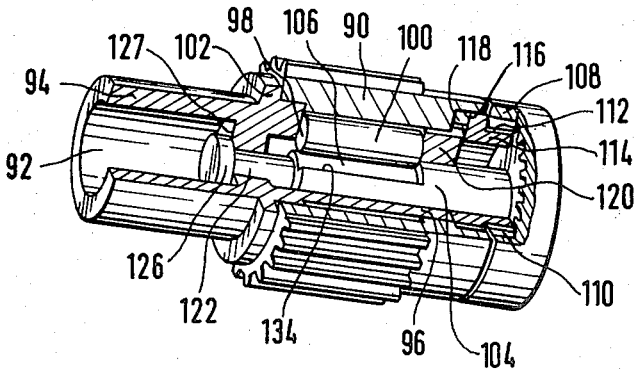
FIG. 11 is a broken three quarter view of the freewheel shown in FIGS. 7—10.

Referring to the drawings, the drive mechanism shown in FIGS. 1 to 6 serves to move and turn the vertical slats of a blind. A control shaft 2 is provided with longitudinal radial recesses 4, FIGS. 3 and 6, between which full-diameter sections 6 are arranged in a drive tube 8 enclosing the control shaft with a clearance. The control shaft 2 is held in a central rest position relative to the drive tube 8 by means of a return spring 10, FIGS. 1, 5 and 6, and can be turned to both sides by a certain angular amount from this rest position. The drive tube 8 contains three openings 12 assigned to the recesses 4 or the full-diameter sections 6 and in each of which a cylindrical blocking element 14, FIGS. 3, 4, and 6, is arranged which can be moved radially.

A further opening 16, which is offset axially relative to the openings 12, is provided through which a follower spring 20 passes outward which is inserted in a slot-shaped recess 18 of the control shaft 2. The driving tongue 20 engages with its part protruding past the outer radius of the drive tube 8 an axial groove 22 of a toothed casing 24 supported on the drive tube 8, such that it is possible to turn toothed casing 24 and control shaft 2, on the one hand, and drive tube 8 on the other with respect to each other and limited by the angular extent of opening 16. An essentially radial disc 26 is rotatable within an extension 9 of the drive tube 8 and is connected rotatable with the control shaft 2. The disc 26 has a projection 28 pointing in the axial direction. Between one face of the disc 26 and an opposite face of the drive tube 8 circular, single-thread return spring 10 is arranged encircling the control shaft 2 and fitting with its two ends 30 bent outward each laterally against the projection 28 of the disc 26 and against a projection 32 pointing radially inward inside the drive tube 8, thus connecting the disc 26 to the control shaft 2 for rotation therewith with the shaft 2 in a predeterminedrotational position relative to the drive tube 8.

Segments 34 extends axially from the extension 9 of tube 8 and protrude into correspondingly shaped recesses 36 in a drive wheel 38, thus forming a connection between drive tube 8 and drive wheel 38 which is rotationally rigid. The drive wheel 38 can be driven in both directions of rotation in a way not shown but known per se by means of a bead chain inserted in its periphery 39.

A further toothed casing 40 is rotatably supported on the drive tube and overlapping openings 12 and is provided with a number of the blocking elements 14, in this case three, or with a number corresponding to an even multiple of this number of follower dogs pointing radially inward. With this toothed casing 40, a toothed wheel 48, supported axially parallel thereto in a housing 44, meshes and is connected rotationally rigidly with a reversing shaft by means of a splined pin 47. The reversing shaft 46 drives a worm gear or similar, not shown, to turn the individual slats.

A third hollow toothed casing 50, provided in its interior surface with an axial, cross-sectionally semicircular groove 52, meshes with the toothed casing 24 enclosing the drive tube 8. The toothed casing 50 is rotatably supported on a freewheel shaft 54. The freewheel shaft 54 is provided with an end section 56 shaped as a tubular shaft connected rotationally rigidly with the screw drive 58, effecting the movement of the slats in a manner not shown, by means of a splined pin 60. In the section located in the region of the toothed casing 50 of the circumference of the freewheel shaft 54 is provided with a cross-sectionally semicircular groove 62 running axially helically and in the place of crossing of which with the axial groove 52 of the toothed casing 50 a rolling body 68 is arranged which is shaped as a sphere or cylinder.

At its end opposite the screw drive 58 the freewheel shaft 54 is provided with a brake cone 70 against which a correspondingly shaped brake disc 72 is pressed by means of a compression spring 74. The brake disc 72 is held fast against rotation by means of a radial projection 73 projecting into an axial groove 75 of the housing 44. One end of the compression spring 74 fits against the face of the brake disc 72 and its other end is held by a stop plate 77, onto which presses the head of a screw 79. The screw 79 is screwed into a threaded hole 81 provided for this purpose in the end-section of the freewheel shaft 54. By turning the screw 79 the braking effect of the braking disc 72 abutting the brake cone 70 can be adjusted.

In the exploded view shown in FIG. 6 individual parts as, e.g., the drive wheel 38, are indicated only diagrammatically as far as parts are concerned which are not essential to the invention.

If the drive wheel 38 is rotated by means of a bead chain not shown, or a counter gear wheel, this rotation is transferred to the drive tube 8 connected rotationally rigidly thereto. If the rolling body 68 located between freewheel shaft 54 and toothed casing 50 is not at one end 64 or 66, respectively, of the helical groove 62 the toothed casing 50 will rotate loosely on the freewheel shaft 54. The control shaft 2 is held in the central rest position relative to the drive tube within the drive tube 8 by means of the disc 26 and the return spring 10 such that the full diameter sections 6 of the control shaft 2, i.e., those which do not fall into a recess, are located below the openings 12 of the drive tube 8 and push the blocking elements 14 into their radially outer position. These are thus placed into the path of the movement of the follower dogs 42 of the toothed casing 40 and form a rotational rigid connection between drive tube 8 and toothed casing 40. Thus the rotation of the drive wheel is transferred via the toothed casing 40 to the toothed wheel 48 and thus to the reversing shaft 46 rotationally rigidly connected thereto, so that the slats are turned about their longitudinal axis. The gearing is adjusted such that the rolling body 68 in the helical groove 62 has reached one of the end-positions 64 or 66, respectively, at the end of the turning movement of the slats. This results in a force-locking connection between freewheel shaft 54 and toothed casing 50 in the direction of rotation. The toothed casing 24 now has to drive the toothed casing 50 and the freewheel shaft coupled by means of the rolling body 68 with the latter casing, and the screw drive connected rotationally rigidly with the freewheel shaft, against the resistance of the braking torque exerted by the guide means of the slats on the screw drive and by the brake disc 72 on the freewheel shaft 54. This suddenly increased rotational torque must be transferred from the drive tube 8 to the control shaft 2 via the return spring 10 and the disc 26, and from the control shaft 2 to the freewheel shaft 54 via the driving tongue 20 and the toothed casing 24. The returned spring 10 is construed in such a way that with the onset of this considerably higher torque load it is turned from its rest position by half the turning range of the driving tongue 20 in the opening 16 of the drive tube 8. As soon as the driving tongue 20 has reached one circumferential end of the opening 16 the initial rotational torque is transferred from the drive tube 8 via the driving tongue 20 located against the end of the opening 16 to the toothed casing 24, and from this to the toothed casing 50.

Due to the rotation of the return spring 10, the disc 26 and thus the control shaft 2 relative to the drive tube 8 the recesses 4 of the control shaft 2 come to align with the openings 12 of the drive tube 8 and thus allow the blocking elements 14 to withdraw out of the path of the movement of the follower dogs 42 of the toothed casing 40 into their radially inner position, so that the toothed casing 40 can rotate freely on the drive tube 8. The toothed wheel 48 is thereby disengaged from the reversing shaft 46. The screw drive 58, now engaged, causes the hanging of slats to move in the guide rail. If the drive wheel 38 is relieved in some position of movement of the hanging of slats, or loaded in the opposite direction of rotation, the return spring 10, deflected from its rest position, at first attempts to return the disc 26 with its rotationally rigidly connected control shaft 2, and which is turned with respect to the drive tube 8, into its central rest position. With this turning of the control shaft 2 its non-recessed profile-sections 6 again come to overlap the openings 12 of the drive tube 8 and push the blocking elements 14 into their radially outer position, in which they are located in the path of the movement of the follower dogs 42 of the toothed casing 40. This again produces a rotationally rigid connection between drive tube 8 and toothed casing 40. If the drive wheel 38 is turned in a rotational direction which is opposite the initial direction of rotation the reversing shaft 46 is driven via the toothed casing 40 and the toothed wheel 48, and the slats are turned into the opposite direction.

Changing the direction of rotation at the drive wheel 38 the rolling body 68 located in one of the end positions 64 or 66 with a stationary freewheel shaft 54 is rolled back in the helical groove 62 due to the rotation of the toothed casing 50 until it has reached its opposite end 64 or 66, respectively. At the same time the slats have completed their turning motion caused by the rotation of the reversing shaft 46 when they have reached the end-of-turn position. Now the toothed casing 24, the toothed casing 50 and the freewheel shaft 54, now rotationally rigidly connected because the rolling body 68 is located against the end 64 of 66 of the helical groove 62, has to be turned with the screw drive 58 against the resistance of the gear mechanisms in the guide means of the individual slats as well as against the braking torque generated by the brake disc 72. This turns the return spring 10 from its central rest position and the reversing shaft 46 is disengaged in the manner described above. The reversing shaft remains stationary while with further rotation of the drive wheel 38 in the same direction the freewheel shaft 54 with the screw drive 58 is put into rotation via the follower spring 20 and the toothed casings connected thereto.

The drive mechanism according to the invention is particularly suited for operation by an electric motor so that basically, the drive wheel does not have to be driven by hand but can also be rotated by motor.

It is merely necessary so that the motor can be reversed in its rotation.

If the wear occuring at the freewheel, and particularly the contact pressure between the rolling body 68 and the ends of the helical groove 62, becomes too great the freewheel shown in the figures 7 to 11 is employed in preference to the freewheel 52,62,68. In FIGS. 7 to 11 all those parts which are not connected with the freewheel have been omitted and the connection with the FIGS. 1 to 6 is established, on the one hand, through the toothed casing 90 corresponding to the third toothed casing 50, and on the other hand through the hole 92 of the cylindrical connecting part 94 of the tubular basic body 96 which accepts in a manner not shown rotationally rigidly the screw drive or, according to application, another shaft to be driven. The basic body 96 has a long rectangular opening 98 containing a cylindrical blocking element 100 which can be shifted radically. Above the opening 98 the toothed casing 90 is supported to rotate on the basic body and is held axially by an annular projection 102 of the basic body. Inside the basic body 96 a hollow blocking shaft 104 is supported to rotate and exibiting a recess 106 which extends over more than half its circumference and which it extends axially at least over the length of the cylindrical blocking element 100. At its end projecting outward the blocking shaft 104 carries an annular disc 108 which corresponds approximately to the circumference of the toothed casing 90 and which is provided with an annular toothed rim 110 pointing radically inward. The toothed rim 110 meshes with a toothing 112 pointing radically outward of a toothed ring 114. The toothed ring 114 is supported in an assentric cylindrical recess 116 of the toothed casing 90. An axial projection 120 of the basic body 96 engages a corresponding recess 118 of the toothed ring 114 and thus fixes the toothed ring rotationally relative to the basic body. The numbers of teeth of the toothed rim 110 and the toothing 112 of the toothed ring 114 are a little different the number of teeth of the toothed ring being a little less than the number of teeth of the inner toothing. Through the hollow blocking shaft 104 passes axially a pin 122 which is fixed at the outer end of the blocking shaft by a cotter 124 and at the opposite end by means of an expanded head 126 at an inner step 127 of the basic body 96. The parts of the freewheel are held together axially by this pin 122.

Figure 10:
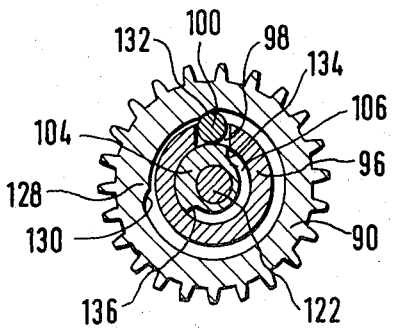
FIG. 10 is a section corresponding to FIG. 9 in the other position of a blocking shaft shown therein.
Figure 8:
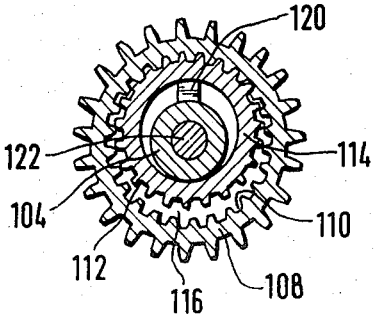
FIG 8 is a section along line VIII—VIII in FIG. 7.
Figure 9:
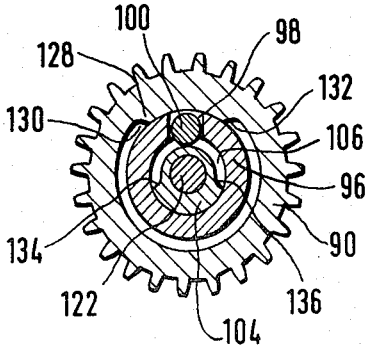
FIG. 9 is a section along line IX—IX in FIG. 7.

As can be seen particularly from the FIGS. 9 and 10, a constriction 128 with two lateral flanks 130 and 132 is provided at the inner circumference of the toothed casing 90 and projecting inward from this circumference and which extends over about a quarter of the total circumference. The recess 106 of the blocking shaft 104 is also provided with two lateral flanks 134 and 136.

The freewheel shown in the FIGS. 7 to 11 operates as follows. When the toothed casing 90 begins to rotate the basic body 96 at first remains fixed because the blocking element 100 is in the inner position shown in the FIGS. 7, 9 and 11 and where it is placed against the recess 106 of the blocking shaft 104. The toothed ring 114 supported in the cylindrical eccentric recess 116 of the toothed casing 90 performs a closed tumbling motion about the centre axis of the arrangement, i.e., the centre axis of the pin 122, during one complete revolution of the toothed casing 90. Because of this tumbling motion the toothing 112 of the toothed ring 114 runs once along the inner toothed rim 110 of the annular disc 108. Because of the somewhat different number of teeth the toothed ring 114, which is held fast by the axial projection 118 relative to the basic body 96 in the direction of rotation, imparts a rotation dependent on the difference in the number of teeth to the annular disc 108 and thus to the blocking shaft 104. This rotation is continued rotation of the toothed casing 90 until one of the flanks 134 or 136 of the recess 106 abuts the blocking element 100. As the blocking element 100 rises up one of the flanks 134 or 136 it is pushed radically outward in the opening 98 and thus arrives in the path of the motion of the constriction 128 of the toothed casing 90. As soon as one of the flanks 130 or 132 of the constriction 128 stops against the blocking element 100 with further rotation of the toothed casing 90 in the same direction, the toothed casing 90 is fixed in this direction to the basic body 96 and carries the latter along in the direction of rotation. In this way the shaft, not shown, anchored fixed in rotation in the hole 92 of the cylindrical connecting part 94 is put into rotation.

As soon as the toothed casing 90 is driven in the opposite direction the blocking element firstly is moved out of abutment with one of the flanks 130 or 132, and then the blocking element, with further relative rotation between blocking shaft 104 and basic body 96, is brought back to abutment at the recess 106 until it is finally pressed outward into its blocking position at the opposite flank 136 or 134 and subsequently abuts one of the flanks 132 or 130.

The freewheel can be adjusted quite simply with respect to its limits and with respect to the mutual setting of toothed casing and driven shaft exchanging individual parts. Firstly, the recess 106 can be changed with respect to its extent along the circumferences and/or the inner toothing 110 with respect to the number of its teeth by installation of another blocking shaft 104 with annular disc 108. Instead, or additionally, however, a toothed ring 114 can also be installed with a different number of teeth in toothing 112. Finally the toothed casing 90 can be exchanged as well, thus altering the circumferential extent of the constriction 128. In the extreme case this circumferential extent can consist only of a dog extending radically at the inner circumference of the toothed casing 90. The blocking shaft, the two toothings and the toothed casing are suitably fitted to each other in the shape of their construction as well as with respect to their mutual setting so that the limited freewheel length between the respective stops is attained as required. In the case of a drive for a blind this setting is chosen approximately such that at first the slats are always turned from one end position of turn into the other end position of turn, and only then the screw drive is coupled in by disengaging the reversing shaft and completion of the freewheel action, and the slats thus are moved apart or together.

If it is required, this embodiment can also be provided additionally with a braking mechanism, such as it is shown with the parts 70, 72, 74, 77, 79 in FIG. 1.

It will be obvious to those skilled in the art that various changes may be made without departing from the spirit of the invention, and therefore the invention is not limited to what is shown in the drawings and described in the specification but only as indicated by the appended claims.

What we claim is:

1. Drive mechanism, particularly for moving and turning the slats of a blind comprising:

(a) a rotatable drive element capable of being rotated in either direction.

(b) a first shaft for operating as a screw drive for shifting the slats of a blind along a guide rail.

(c) a second reversing shaft for turning slots jointly, (d) means for drivingly connecting said rotatable drive element to said first shaft including a freewheel comprising:

(i) a helical groove on said first shaft, (ii) a hollow casing surrounding and spaced from said helical groove and having an axial groove in the interior surface thereof, (iii) a rolling body partially in each said groove, and (iv) means for drivingly connecting said hollow casing and said rotatable drive element, and (e) means for drivingly connecting said rotatable drive element to said second shaft comprising:

(i) a drive tube, (ii) a driven casing surrounding said tube, and (iii) means for drivingly coupling said driven casing to said drive tube comprising radially movable blocking elements engaging in one position thereof said drive tube and said casing and in another portion thereof only one of said tube and casing.

2. Drive mechanism according to claim 1, and means within said driving tube for effecting radial movement of said blocking elements.

3. Drive mechanism according to claim 2, said last mentioned means comprising a control shaft in said drive tube having axially extending recesses, said control shaft being rotatable between two end positions from a central rest position relative to the drive tube, spring means for urging said control shaft to rest position, said blocking elements being in said recesses in said other position thereof and engaging full diameter portions of said control shaft in said one position thererof.

4. Drive mechanism according to claim 3, said casing having inwardly directed and axially extending dogs engaged by said blocking elements in said one position thereof.

5. Drive mechanism according to claim 4, wherein the blocking elements are constructed as rollers, the longitudinal axes of which are arranged parallel to the axis of the drive tube.

6. Drive mechanism according to claim 4, wherein the control shaft is provided with a follower spring protruding radially and which is coupled to the screw drive via the freewheel and passes outward through an opening which limits the two end positions of the control shaft with relation to the drive tube.

7. The mechanism according to claim 6, wherein the follower spring engages an axial groove at the inner surface of a second toothed casing enclosing the drive tube and wherein the second casing meshes with a third toothed casing which is connected to the screw drive via the limited freewheeel.

8. Drive mechanism according to claim 4, wherein a radial disc firmly rotationally jointed to the control shaft is arranged in an expanded part of the drive tube and has a projection pointing in the axial direction which fits against a projection pointing radially inward from the inner surface of the expanded part of the drive tube and wherein the two ends bent outward of the return spring encircling the control shaft fit laterally in the direction of rotation against the two projections.

9. Drive mechanism according to claim 7, whererein the return spring is constructed as a helical spring and is arranged in a radial slot between one face each of the expanded part of the drive tube and the radial disc.

10. Drive mechanism according to claim 1, wherein the rolling body is shaped as a sphere of cylinder and the cross-sections of the two grooves taking the rolling body are fitted to its cross-section.

11. Drive mechanism according to claim 1, wherein the freewheel shaft is provided with a brake cone against which a brake disc fixed in the direction of rotation is pressed by means of a compression spring.

12. Drive mechanism according to claim 11, wherein the brake disc is supported to rotate on the freewheel shaft and with a radial protrusion projects into an axial groove of a fixed housing.

13. Drive mechanism according to claim 12, wherein the compression spring is constructed as a helical spring encircling one end section of the freewheelshaft and the pressure of which against the brake disc can be adjusted by means of a stop plate and a screw inserted into the end of the freewheel shaft.

14. Drive mechanism, particularly for moving and turning the slats of a blind comprising:

(a) rotatable drive element capable of being rotated in either direction.

(b) a first shaft for operating as a screw drive for shifting the slats of a blind along a guide rail.

(c) a second reversing shaft for turning slats jointly, (d) means for drivingly connecting said rotatable drive element to said first shaft including a freewheel comprising:

(i) a tubular basic body fixedly connected to the first shaft, (ii) a hollow casing surrounding at least a portion of said tubular body and rotatable in either direction by said drive element, (iii) radically movable blocking element means for engaging said casing and said body in one position thereof and for engaging only one of said casing and said body in another position thereof to thereby cause conjoint rotational movement of said body by said casing when said blocking element means is in said one position, and (iv) means driven by said hollow casing for moving said blocking element means to said one position after a predetermined amount of rotation of said hollow casing from an initial position, and (e) means for drivingly connecting said rotatable drive element to said second shaft.

15. Drive mechanism according to claim 14, wherein said blocking element means comprises an axially extending body, and wherein said tubular basic body has an axial opening therein, said blocking element body being in said opening.

16. Drive mechanism according to claim 14, wherein said means for moving said blocking element means comprises a blocking shaft within said hollow body having a first axially extending recess therein for permitting said blocking element means to move to said other position.

17. Drive mechanism according to claim 16, wherein said means for moving said blocking element means further comprises gear means connected with said hollow casing and to said shaft within the hollow body.

18. Drive mechanism according to claim 17, wherein said basic body has an axial projection and said gear means comprises an internal gear having a recess receiving said axial projection, and an external toothed gear connected to said blocking shaft.

19. Drive mechanism according to claim 17, said gear means comprising a toothed gear connected to said blocking shaft, means supporting said toothed gear for eccentric motion within said tubular basic body, and a toothed ring fixed to said hollow casing meshing with said toothed gear and having a different number of teeth than said toothed gear.

20. Drive mechanism according to claim 16, wherein the blocking shaft is made hollow and a pin passes through it axially and is fixed axially to the end of the blocking shaft and to an inner step of the basic body.

* * * * *

UNITED STATES PATENT AND TRADEMARK OFFICE

CERTIFICATE OF CORRECTION

PATENT NO. : 4,224,973

DATED : September 30, 1980

INVENTOR(S) : Walter Hugin

It is certified that error appears in the above—identified patent and that said Letters Patent is hereby corrected as shown below:

On the title page Insert

-- (73) Assignee: Bautex Adolf Stover KG, West Germany --.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*